US005867757A

United States Patent [19]

Okazaki et al.

[11] Patent Number: 5,867,757

[45] Date of Patent: Feb. 2, 1999

[54] DEVELOPING AGENT REPLENISHING DEVICE AND IMAGE FORMING APPARATUS WITH THE DEVICE

[75] Inventors: Shigeru Okazaki; Makoto Ui, both of Hachioji, Japan

[73] Assignee: Konica Corporation, Japan

[21] Appl. No.: 12,896

[22] Filed: Jan. 23, 1998

[30] Foreign Application Priority Data

Jan. 30, 1997 [JP] Japan ..... 9-016659

[51] Int. Cl.[6] ..... G03G 15/08

[52] U.S. Cl. ..... 399/262; 399/120; 399/258; 399/260

[58] Field of Search ..... 399/258, 260, 399/262, 119, 120; 222/DIG. 1, 325, 167; 141/383, 384, 363

[56] References Cited

U.S. PATENT DOCUMENTS

| | | | |
|---|---|---|---|
| 4,641,945 | 2/1987 | Ikesue et al. | 399/262 |
| 4,739,907 | 4/1988 | Gallant . | |
| 4,937,625 | 6/1990 | Kato et al. . | |
| 5,057,872 | 10/1991 | Saijo et al. . | |
| 5,481,344 | 1/1996 | Yasuda et al. | 399/120 |
| 5,655,180 | 8/1997 | Yasuda et al. | 399/258 X |
| 5,669,044 | 9/1997 | Cuthbert | 399/120 |

FOREIGN PATENT DOCUMENTS

| | | |
|---|---|---|
| 0225745 | 6/1987 | European Pat. Off. . |
| 0689104 | 12/1995 | European Pat. Off. . |
| 0801337 | 10/1997 | European Pat. Off. . |
| 9-160362 | 6/1997 | Japan . |
| 9-190059 | 7/1997 | Japan . |
| 9-211947 | 8/1997 | Japan . |

OTHER PUBLICATIONS

European Search Report EP 98 30 0533.

EPO—Patent Abstracts of Japan, Publication #60220372, Publication date: May 11, 1985 (Abstract, 1 page).

*Primary Examiner*—Matthew S. Smith

*Attorney, Agent, or Firm*—Jordan B. Bierman; Bierman, Muserlian and Lucas

[57] ABSTRACT

A developing agent replenishing device includes: a developing agent storing container having a spiral protrusion in an interior thereof, including a container main body for storing therein a developing agent and a movable cover for opening or closing a developing agent discharging opening provided on one end of the container main body; a container mounting section to which the storing container is mounted, wherein the developing agent stored in the storing container is discharged by rotating the storing container; a developing agent reserving section for reserving therein the developing agent discharged from the storing container; a cover engagement portion for engaging with the movable cover when the storing container is mounted to the container mounting section; and a holding and moving device for holding a part of the storing container and for moving the storing container when the storing container is mounted to the container mounting section. The movable cover and the storing container main body are relatively moved by moving the storing container by the holding and moving device, thereby the discharging opening is opened, and consequently communicates with the developing agent reserving section so that the developing agent in the storing container can be discharged.

6 Claims, 7 Drawing Sheets

D1
D2
B
A
X
10
11
11A
11B
11C
11D
11E
11G
11H
11J
11L
12
13
13A
13B
13C
13D
14
15
R
H1
H2
P1
P2

DEVELOPING AGENT REPLENISHING DEVICE AND IMAGE FORMING APPARATUS WITH THE DEVICE

BACKGROUND OF THE INVENTION

The present invention relates to a developing agent replenishing device to replenish developing agents to developing devices of an image forming apparatus such as an electrophotographic type copier, facsimile, printer, etc., and relates to an image forming apparatus.

In the image forming apparatus such as an electrophotographic copier, facsimile, printer, etc., employing an electrophotographic method in which an electrostatic latent image is formed on a photoconductive photoreceptor, the latent image is developed by the charged developing agent in the developing device, and a visual image obtained by the developing agent is transferred onto a transfer material, a predetermined amount of developing agent is automatically replenished from a developing agent replenishing device to the developing device in order to keep the concentration of developing agent in the developing device constant. Accordingly, the user of the image forming apparatus is required to replenish the developing agent at every predetermined period of time from a developing agent container to the developing agent replenishing device.

Conventionally, as a means for replenishing the developing agent to the image forming apparatus, there is a means of a type in which the developing agent container is set in the apparatus main body when the developing agent is replenished, the entire amount of developing agent in the developing agent container is replenished to a developing agent storing portion, and the developing agent container is removed from the apparatus main body after the replenishment has been completed. However, in the above-described type of replenishing method, there is a possibility that the developing agent overflows the developing agent storing portion when the developing agent is excessively replenished at a time to the developing agent storing portion. Accordingly, it is necessary to provide a means to prevent the excessive replenishment of the developing agent. It is difficult to prevent the excessive replenishment of the developing agent, and even if the excessive replenishment preventing means for the developing agent can be mounted in the apparatus main body, the cost of the apparatus becomes expensive, and the overall size of the apparatus becomes larger.

Accordingly, a means of a type is developed in which the developing agent container having a spiral protrusion therein is set to the apparatus main body; the developing agent container is rotated around its central axis; the developing agent is delivered from a developing agent delivering port of the developing agent container; and the developing agent is replenished into the developing agent storing portion, (Japanese Patent Publication Open to Public Inspection No. 295356/1995, etc.). In this type of means, because the developing agent container is always installed in the apparatus main body, the developing agent container can be rotated at any time so that the developing agent is replenished into the developing agent storing portion, when the amount of developing agent in the developing agent storing portion is decreased.

Accordingly, the developing agent replenishing device is proposed, or provided, in which the developing agent replenishing device is accommodated in the image forming apparatus and used, while the developing agent container is directly mounted in the developing agent replenishing device.

Conventionally, there are various types of developing agent replenishing devices using bottle-like developing agent containers. For example, there is a developing agent replenishing device in which a spiral protrusion is formed on the inner peripheral surface of a cylindrical container main body; the developing agent container, in which a developing agent delivering port is formed at one end side of the container main body, is mounted almost horizontally in an image forming apparatus; next, the developing agent replenishing container is rotated around its axis; thereby, the developing agent accommodated in the container main body is moved by the spiral protrusion towards the developing agent delivering port side, and is delivered from the developing agent delivering port; and the delivered developing agent is supplied into the developing device.

A cap is detachably provided on the developing agent delivering port, and the developing agent container, from which the cap is detached so that the developing agent delivering port is opened, is mounted in the image forming apparatus.

Further, conventionally, there is also a developing agent container, in which the developing agent delivering port of the container is kept upward, a seal to close the developing agent delivering port is peeled by hands, and the container is mounted in the apparatus main body while the developing agent delivering port is kept upward.

Still further, there is also a developing agent container in which, when the cylindrical developing agent container is mounted in the apparatus main body, a phase is positioned in the rotational direction of the cylindrical developing agent container, and then the developing agent container is pushed in the direction of the cylinder axis (Japanese Patent Publication Open to Public Inspection No. 75769/1988).

The object of the present invention is to solve the following problems in the developing agent container, and the developing agent replenishing device which supplies the developing agent from the developing agent container to the developing device. The problems to be solved by the present invention will be described below.

(1) Conventionally, when the developing agent container is mounted in the container mounting portion, the rotational direction of the developing agent container is needed to be positioned, resulting in bothersome mounting operations and a possibility of mis-mounting.

(2) In the developing agent container whose developing agent delivering port is closed by a seal member, the peeling operation of the seal member is necessary to be conducted for each port, before and after mounting the developing agent container into the container mounting portion. Accordingly, when the mounting operation and the peeling operation are conducted for each container, there are problems that the developing agent is leaked from the developing agent container by the mis-operation and scattered to its surrounding, and a developing agent replenishment error occurs.

(3) There is a possibility that the remaining developing agent in the developing agent container leaks from the developing agent delivering port and stains the surrounding, when the developing agent container is taken out from the container mounting portion and replaced by a new one.

(4) In the developing agent replenishing device of a type in which the developing agent container is held, pushed and directly loaded into the container mounting portion, there are problems in which the mounting of developing agent container is difficult, the developing agent replenishing error or a display for the mis-operation occurs because of imperfect mounting of the container, and the developing agent stains hands or clothes of the operator.

SUMMARY OF THE INVENTION (1) In a developing agent replenishing device of the present invention in which a developing agent storing container having a spiral protrusion therein is mounted in a container mounting section, and in which the developing agent accommodated in the developing agent container is delivered into a developing agent reserving section by rotating the developing agent storing container, the developing agent replenishing device is characterized in that the developing agent storing container has a container main body, in which the developing agent is accommodated and at one end of which a developing agent delivering port is provided, and has a movable opening/closing cover to open/close the developing agent delivering port; the developing agent replenishing device has an opening/closing cover engagement section to engage with the movable opening/closing cover when the developing agent storing container is mounted in the container mounting section, and has a moving and holding means which holds a part of the developing agent storing container when the developing agent storing container is mounted in the container mounting section, and moves the developing agent storing container; by moving the developing agent storing container by the moving and holding means, the movable opening/closing cover and container main body are relatively moved, so that the developing agent delivering port becomes open; and the developing agent delivering port communicates with the developing agent reserving section, so that the developing agent can be delivered from the developing agent storing container.

(2) In an image forming apparatus of the present invention provided with an developing agent replenishing device in which a developing agent storing container having a spiral protrusion therein is mounted in a container mounting section, and in which the developing agent accommodated in the developing agent storing container is delivered into a developing agent reserving section by rotating the developing agent storing container, the image forming apparatus is characterized in that the developing agent storing container has a container main body, in which the developing agent is accommodated and at one end of which a developing agent delivering port is provided, and has a movable opening/closing cover to open/close the developing agent delivering port; the developing agent replenishing device has a moving and holding means composed of an opening/closing cover engagement section to engage with the movable opening/closing cover, and a moving and holding member which holds a part of the developing agent storing container, and moves the developing agent storing container, and a knob to move the moving and holding member; a mounting section main body of the container mounting section is supported so as to be oscillated, on an oscillating axis provided in the image forming apparatus main body; and in a position where the mounting section main body is oscillated and exposed toward the outside of the image forming apparatus main body, the knob is operated so that the developing agent storing container can be attached to and detached from the container mounting section.

BRIEF DESCRIPTION OF THE DRAWINGS

FIG. 1(*b*) is a view of the developing agent container viewed from arrow A.

FIG. 1(*c*) is a view of the developing agent container viewed from arrow B.

FIG. 1(*d*) is a view, viewed from the arrow A, in which a slide cover is moved and a delivering port is opened.

FIG. 2(*b*) is a sectional view showing a condition in which the flexible seal member is peeled and the developing agent delivering port is opened.

DETAILED DESCRIPTION OF THE PREFERRED EMBODIMENT

Figure 1:
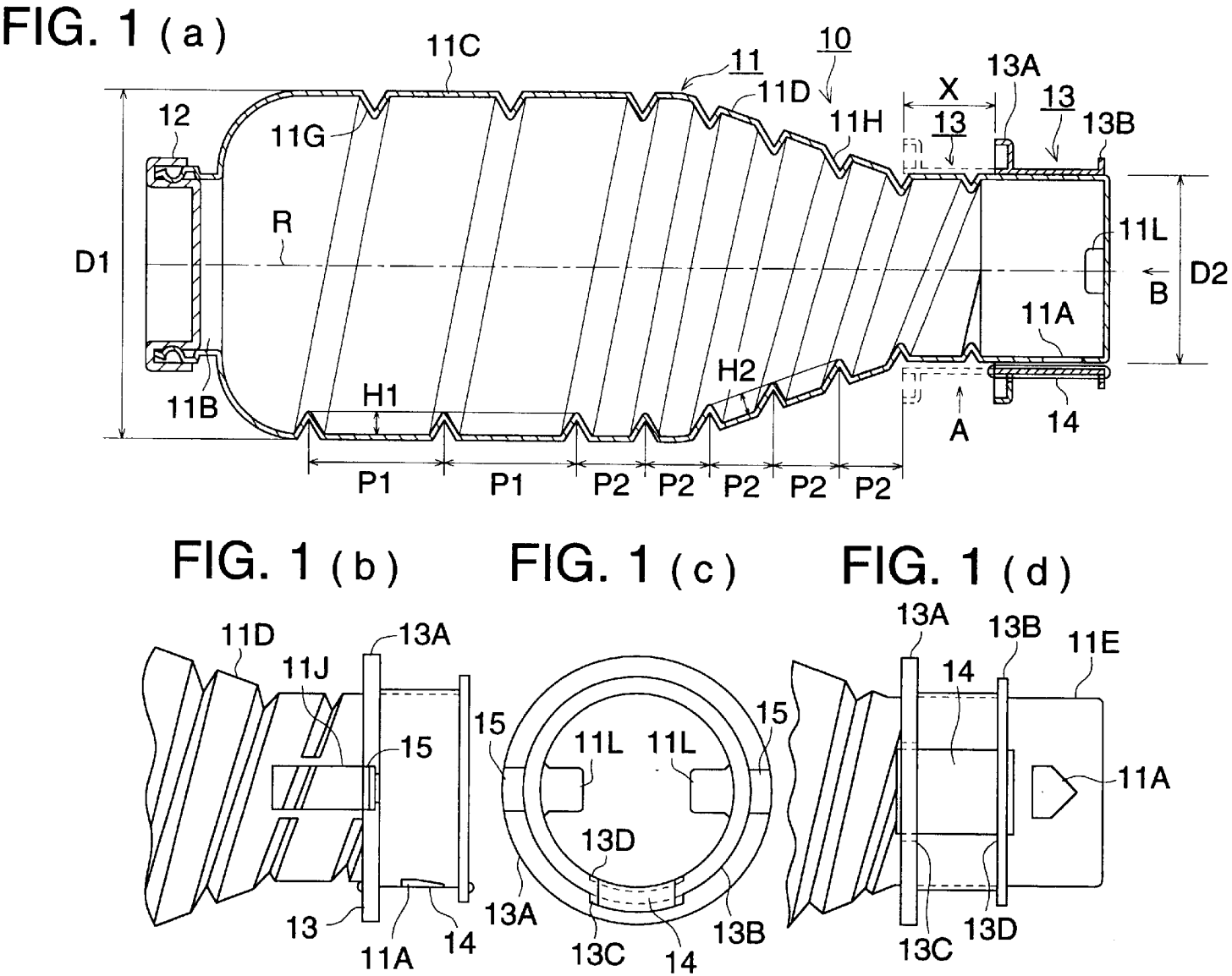
FIG. 1(*a*) is a sectional view of a developing agent container.

Referring to the drawings, an embodiment of the present invention will be described below.

FIG. 1(*a*) is a sectional view of a developing agent container. FIG. 1(*b*) is a view of the developing agent container viewed from arrow A. FIG. 1(*c*) is a view of the developing agent container viewed from arrow B. FIG. 1(*d*) is a view, viewed from the arrow A, in which a slide cover is moved and a delivering port is opened.

The developing agent container 10 (referred to as container, hereinafter) is composed of a container main body 11, a fixed cover 12 to close an opening provided on one end surface of the container main body 11, a movable slide cover 13 (movable opening/closing cover) to open/close a developing agent delivering port 11A provided on the outer peripheral surface of the other end surface of the container main body 11, and an endless flexible seal member 14 which is adhered to near the developing agent delivering port 11A and can be peeled. The flexible seal member 14 is formed to be endless by adhering both ends of the thin film made of polyethylene terephthalate (PET), or the like.

An opening 11B on one end surface of the container main body 11 is provided for the purpose of loading the developing agent into the container main body 11, and is tightly closed by the fixed cover 12.

The container main body 11 is structured by a hollow cylindrical wall surface portion 11C, a hollow conical wall surface portion 11D and a hollow cylindrical wall surface portion 11E with a small diameter bottom which is connected to a leading edge portion of the a hollow conical wall surface portion 11D. A diameter D2 of the hollow cylindrical wall surface portion 11E with the bottom is about ½ of a diameter D1 of the hollow cylindrical wall surface portion 11C, and both the cylindrical wall surface portions 11C and 11E are connected by hollow conical wall surface portion 11D. For example, the diameter D1 of the hollow cylindrical wall surface portion 11C is set to 110 mm, and the diameter D2 of the hollow conical wall surface portion 11D is set to 55 mm.

On the inner peripheral surface of the hollow cylindrical wall surface portion 11C, a spiral protrusion 11G protrudes to the inside of the container main body 11, and forms a developing agent guide portion. Further also, on the inner peripheral surface of the hollow conical wall surface portion 11D, a spiral protrusion 11H protrudes to the inside of the container main body 11, and forms the developing agent guide portion.

A pitch P2 of the spiral protrusion 11H formed on the hollow conical wall surface portion 11D is formed shorter than a pitch P1 of the spiral protrusion 11G formed on the hollow cylindrical wall surface portion 11C (P1>P2). For example, the pitch P1 of the protrusion 11G is set to 40 mm, and the pitch P2 of the protrusion 11H is set to 20 mm.

The height H2 of thread of the spiral protrusion 11H formed on the hollow conical wall surface portion 11D, is formed higher than the height of thread H1 of the spiral protrusion 11G formed on the hollow cylindrical wall surface portion 11C (H2>H1). For example, the height H1 of thread of the protrusion 11G is set to 4–6 mm, and the height H2 of thread of the protrusion 11H is set to 6–8 mm.

In the container 10 of the present invention, the diameter D1 of the hollow cylindrical wall surface portion 11C of the container main body 11, in which the developing agent is mainly accommodated, is made larger, and the diameter D2 of the hollow cylindrical wall surface portion 11E with the bottom of the leading edge portion of the container main body 11, in which the developing agent delivering port 11A is provided, is made smaller. These two portions are connected by the conical one, and thereby, a problem of the space for the container mounting portion can be solved.

The pitch P2 of the spiral protrusion 11H formed on the hollow conical wall surface portion 11D is formed shorter than the pitch P1 of the spiral protrusion 11G formed on the hollow cylindrical wall surface portion 11C (P1>P2). Further, the height H2 of thread of the spiral protrusion 11H formed on the hollow conical wall surface portion 11D, is formed higher than the height of thread H1 of the spiral protrusion 11G formed on the hollow cylindrical wall surface portion 11C (H2>H1). Thereby, the conveyance capacity of the developing agent in the hollow conical wall surface portion 11D is increased, so that the developing agent can easily be conveyed to the developing agent delivering port 11A.

The inner peripheral surface of the slide cover 13 can slide on the outer peripheral surface of the hollow cylindrical wall surface 11E with the bottom. Long groove portions 11J with the bottom formed at two positions on the outer peripheral surface of the hollow cylindrical wall surface portion 11E with the bottom, engage two protrusion members 15 fixed on the slide cover 13, and the slide cover 13 can linearly move along the rotation central axis R on the outer peripheral surface 11K of the hollow cylindrical wall surface portion 11E with the bottom.

Figure 2:
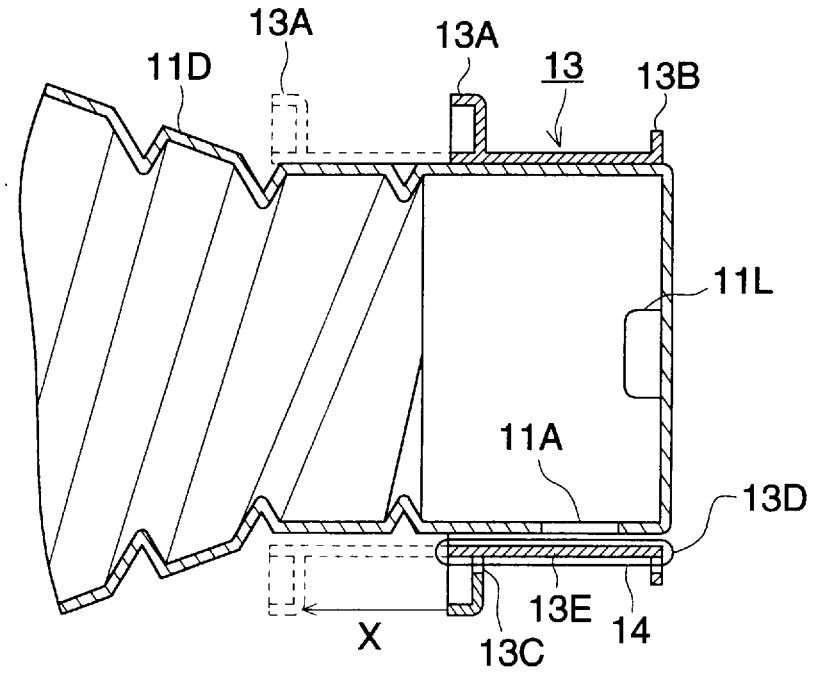
FIG. 2(*a*) is a sectional view showing a condition in which a developing agent delivering port is closed by a flexible seal member.
Figure 2:
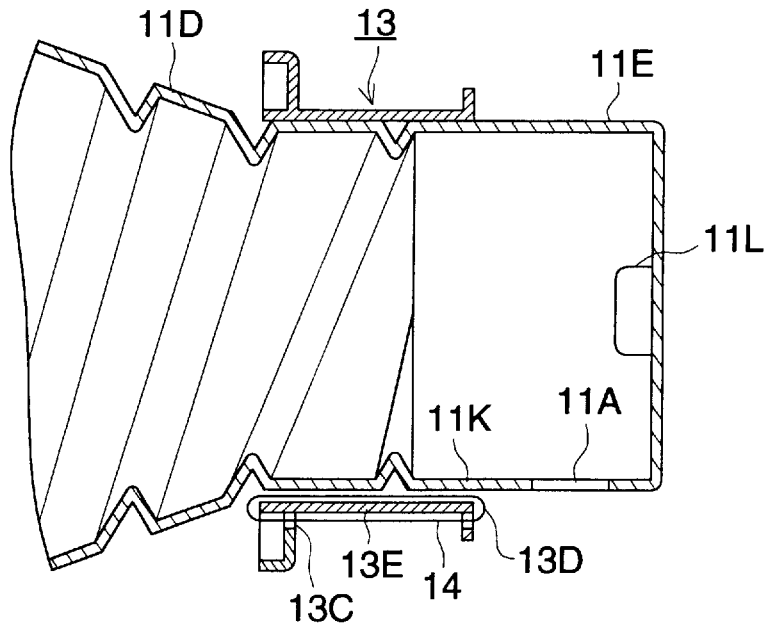
Figure 3:
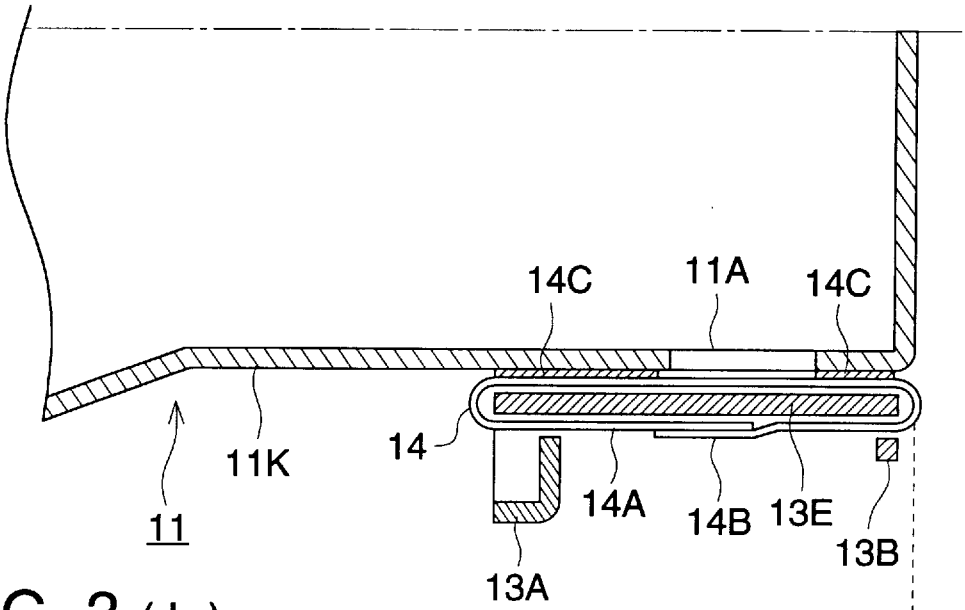
FIGS. 3(*a*) and 3(*b*) are enlarged sectional views respectively showing the slide cover and the flexible seal member near the developing agent delivering port of the container.
Figure 3:
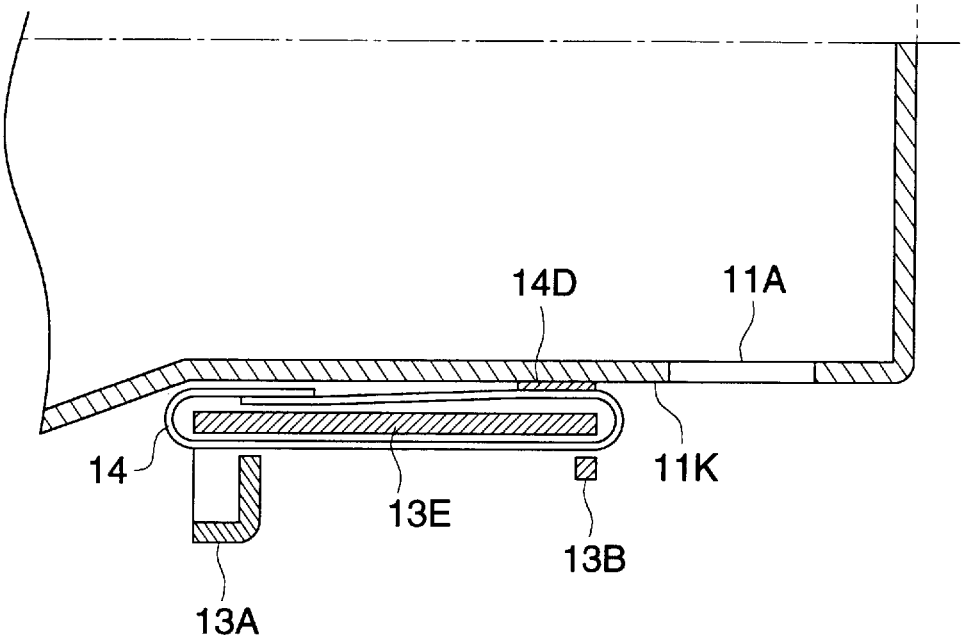

FIG. 2(*a*) is a sectional view showing a condition in which the developing agent delivering port 11A is closed by a flexible seal member, and FIG. 2(*b*) is a sectional view showing a condition in which the flexible seal member is peeled and the developing agent delivering port 11A is opened. FIG. 3 is an enlarged sectional view showing the slide cover 13 and the flexible seal member 14 near the developing agent delivering port 11A of the container 10. FIG. 3(*a*) shows a condition in which the developing agent delivering port 11A is closed by the flexible seal member 14, and FIG. 3(*b*) shows a condition in which the developing agent delivering port 11A is opened by the flexible seal member 14.

Flange portions 13A and 13B protrude on both ends in the direction of the rotation central axis R of the slide cover 13. A slit 13C is provided in one flange portion 13A, and a slit 13D is provided in the other flange portion 13B.

One end portion 14A of the flexible seal member 14, adhered near the developing agent delivering port 11A, slidingly contacts with the inner peripheral surface of the slide cover 13, U-turns at the end portion of the flange portion 13A, and passes through the slit 13C to the outer peripheral surface of the cylindrical portion 13E of the slide cover 13. Also, the other end portion 14B of the flexible seal member 14 slidingly contacts with the inner peripheral surface of the slide cover 13, U-turns at the end portion of the flange portion 13B, and passes through the slide 13D to the outer peripheral surface of the cylindrical portion 13E of the slide cover 13. Thus, both end portions 14A and 14B of the flexible seal member 14 are superimposed on each other on the outer peripheral portion of the slide cover 13, and here both end portions 14A and 14B are adhered to each other by thermal adhesion (heat seal) or the like, and are formed into the shape of an endless belt.

A portion of the flexible seal member 14, which comes into contact with the outer peripheral surface 11K of the hollow cylindrical wall surface portion 11E with the bottom, is the adhered portion 14C which is previously adhered around the developing agent delivering port 11A, and closes the developing agent delivering port 11A. When the slide cover is moved in the direction of X, shown in the drawing, by the outer force, the flexible seal member 14, wound around the slide cover 13, is rotated and the developing agent delivering port 11A is gradually opened.

When the slide cover 13 arrives at the final position shown in FIGS. 2(*b*), 3(*b*), and 1(*d*), the developing agent delivering port 11A is fully opened, so that delivery of the developing agent can be started. Under this full-opened condition of the developing agent delivering port 11A, only the adhered portion 14D of the adhered portions of the flexible seal member 14 is kept under a connected condition in which the adhered portion 14D is adhered to the outer peripheral surface 11K of the hollow cylindrical wall surface portion 11E with the bottom.

Next, when the slide cover 13 is moved in the direction reverse to that of X, the flexible seal member 14 is rotated around the cylindrical portion 13E of the slide cover 13, and the developing agent delivering port 11A is gradually closed; and when the flexible seal member 14 arrived at the final return position of the slide cover 13, the developing agent delivering port 11A is perfectly closed by the flexible seal member 14. When the container 10 under the condition in which the developing agent delivering port 11A is closed, is removed from the container mounting portion 20 (refer to FIG. 4), there is no possibility that the developing agent accommodated in the container 10 leaks outside.

In the relative movement of the container main body 11 and the slide cover 13, any of the following operation methods can be acceptable in which the container main body 11 is located at a predetermined position of the container mounting portion 20, and the slide cover 13 is moved; or the slide cover 13 is located at a predetermined position of the container mounting portion 20, and the container main body 11 is moved.

That is, the slide cover 13 is located at a predetermined position of the container mounting portion 20, and the container main body 11 is moved toward the slide cover 13 by grasp, or held by an operation member, and thereby, the developing agent delivering port 11A is opened.

Alternatively, the container main body 11 is located at a predetermined position of the container mounting portion 20, the slide cover 13 is moved, and thereby, the developing agent delivering port 11A may be opened.

In FIGS. 1 and 2. an idle coupling portion 11L is provided on a bottom portion of the hollow cylindrical wall surface portion 11E with the bottom, and is detachably engaged with a drive coupling member 33 which is connected to a drive source (motor M), provided in a drive portion, which will be described later.

Figure 4:
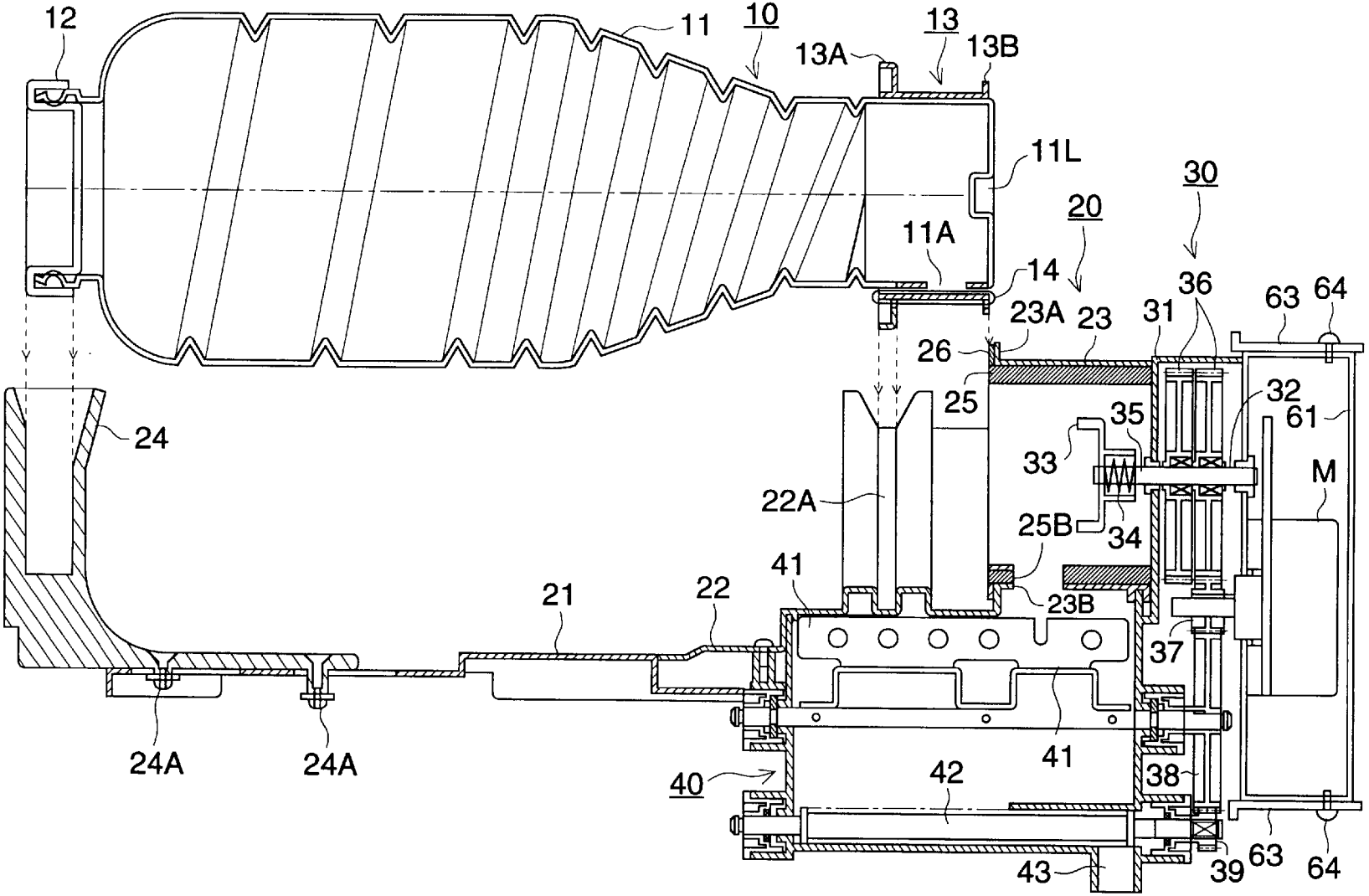
FIG. 4 is a sectional view showing a condition before the container is mounted in a container mounting portion.

FIG. 4 is a sectional view showing a condition before the container 10 is mounted in the container mounting portion 20.

The container mounting portion 20 is composed of a mounting portion main body 21, a slide cover holding member (opening/closing cover holding member) 22, a container main body holding member 23, and a fixed cover holding member 24. A groove portion of the slide cover holding member 22 (opening/closing cover engagement portion) 22A positions and holds the flange portion 13A of the slide cover 13. The inner peripheral surface of the container main body holding member 23 is the cylindrical shape, and a porous member 25 is adhered thereto. The porous member 25 is formed from material capable of being resiliently deformed such as form polyurethane resin, or the like. The outer peripheral surface 11K of the container main body 11 is slidingly mounted on the inner peripheral surface of the porous member 25. A porous member 26 is adhered to a flange portion 23A provided at an inlet portion of the container main body holding member 23, and is pressure-contacted with the flange portion 13B of the slide cover 13.

When the container 10 is mounted in the container mounting portion 20, air in the container mounting portion 20 is compressed, however, because the porous member 25 capable of being resiliently deformed is provided on the container contact surface of the container mounting portion 20, the porous member 25 operates as a filter, and it is prevented that the developing agent in a developing agent storing portion 40 leaks outside the apparatus with the compressed air.

On the wall surface of a casing 31 of the drive portion 30 in the depth side of the container main body holding member 23, a rotation shaft 32 connected to a drive source is rotatably supported by a bearing. On the leading edge portion of the rotation shaft 32, a drive coupling member 33 activated by a spring 34 is supported movably in the direction of the shaft by a key 35. The drive coupling member 33 can be engaged with and disengaged from an idle coupling portion 11L, formed on the leading edge portion of the container main body 11.

A gear 36 with a built-in one-way clutch is fixed on the trailing edge portion of the rotation shaft 32. The drive force of the gear 36 is transmitted from the drive source motor M through a gear 37.

The motor M drives a developing agent stirring member (paddle) 41 in the developing agent storing portion (hopper) 40 having a gear 38 through the gear 37. A gear 39 engaged with the gear 38 drives a developing agent conveyance member (screw) 42 in the developing agent storing portion 40.

Figure 5:
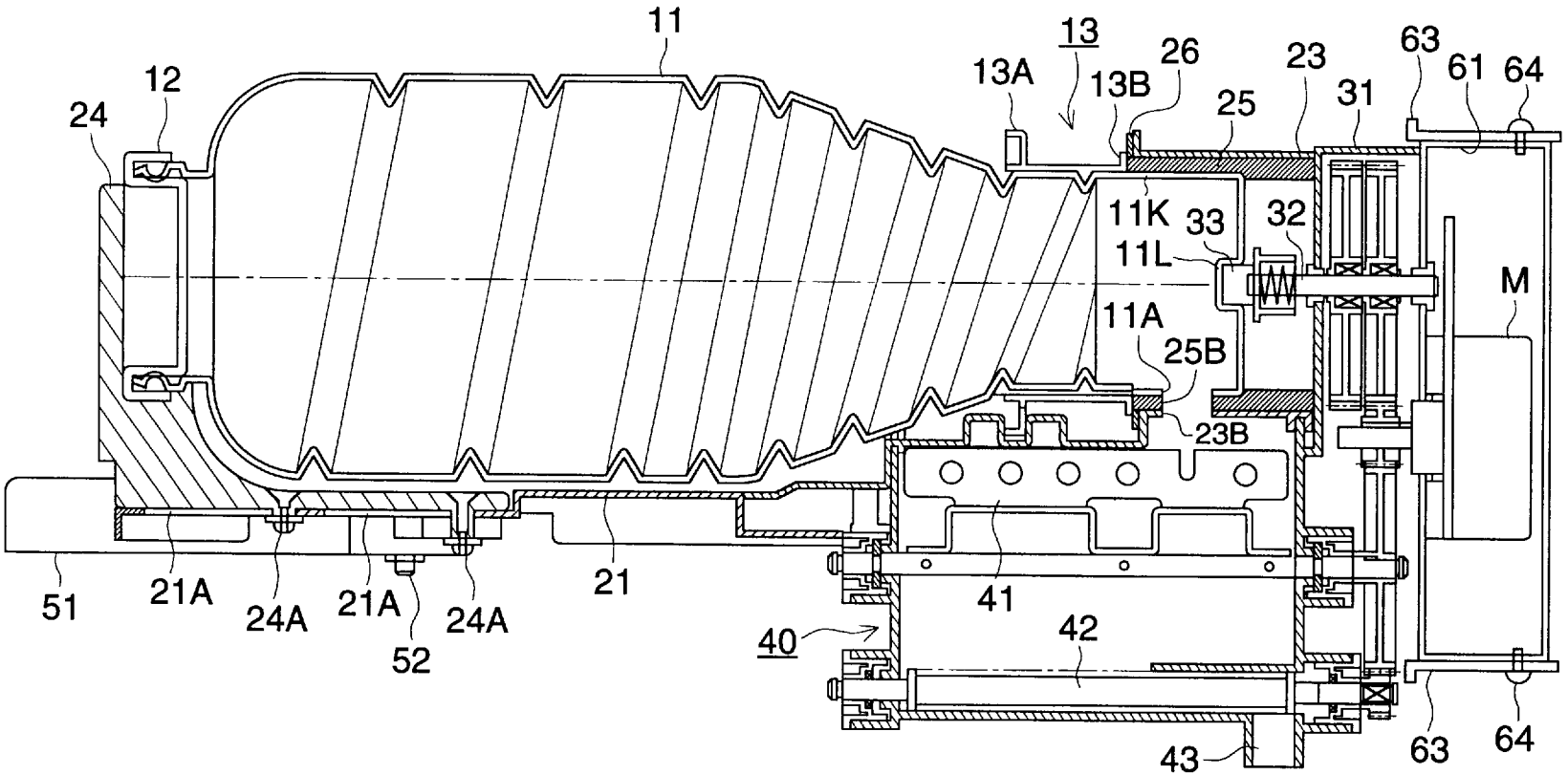
FIG. 5 is a sectional view showing a condition in which the container has been mounted in the container mounting portion.

FIG. 5 is a sectional view showing a condition in which the container 10 has been mounted in the container mounting portion 20.

Initially, the container 10 is grasped, and the slide cover 13 is inserted into a groove portion 22A of the slide cover holding member 22, and positioned for mounting. Under this mounting condition, the flange portion 13B of the slide cover 13 is pressure-contacted with the porous member 26, thereby, leakage of the developing agent is prevented.

Next, when an operation lever 51 is operated, and a fixed cover holding member 24 is moved right in the drawing, the fixed cover holding member 24 presses the fixed cover 12, the container main body 11 is moved right in the drawing, and the outer peripheral surface 11K of the container main body 11 comes into pressure-contact with the inner peripheral surface of the porous member 26, slidingly moves thereon, and advances. The idle coupling portion 11L comes into contact with the drive coupling member 33 of the leading edge portion of the rotation shaft 32, near the final point of the movement of the container main body 11. A protruded portion of the drive coupling member 33 is activated by the spring, and when the rotation shaft 32 is rotated by the motor M, the protruded portion is engaged with the recessed portion of the idle coupling portion 11L, thereby, the container 10 is rotated.

In the movement process of the container main body 11 by the movement of the fixed cover holding member 24, the slide cover 13 is not moved because it is engaged with the groove portion 22A of the slide cover holding member 22, and thereby, the flexible seal member 14 fully opens the developing agent delivering port 11A of the container main body 11. At the full-opened position of the developing agent delivering port 11A, when the container 10 is rotated by the drive of the motor M, the developing agent is conveyed into the container main body 11 by spiral protrusions 11G and 11H, and accommodated in the container main body 11. When the developing agent delivering port 11A coincides with the opening 25B of the porous member 25 and the opening 23B of the container main body holding member 23, the developing agent can be delivered into the developing agent storing portion 40, located at the lower portion, through these port and openings 11A, 25B, and 23B.

The developing agent delivered into the developing agent storing portion 40, is stirred by a developing agent stirring member 41, conveyed by a developing agent conveyance member 42, delivered from a developing agent outlet 43, and supplied to a developing device, not shown in the drawings.

In this connection, under the condition shown in FIG. 5, the outer peripheral surface 11K of the container main body 11 has been inserted into the porous member 25, and therefore, the container 10 can not be taken out.

Figure 6:
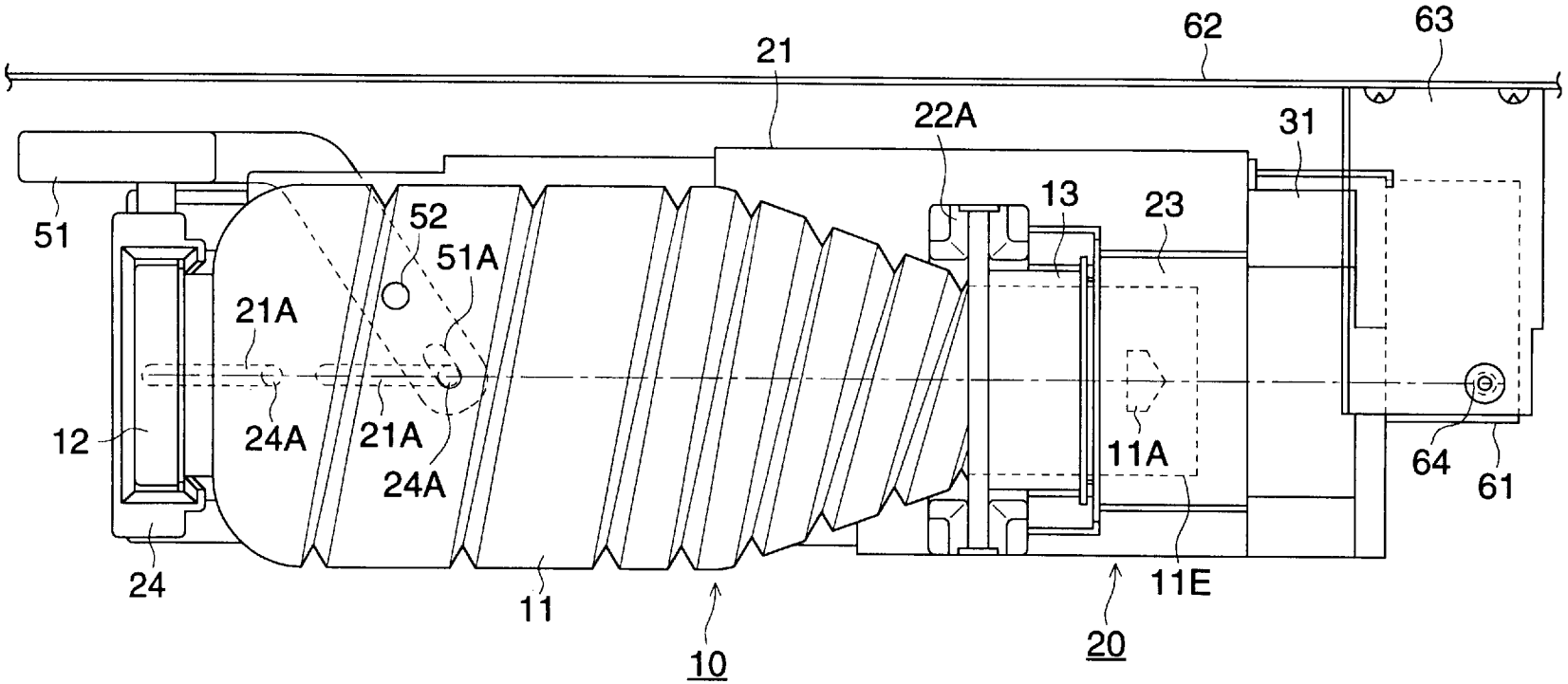
FIG. 6 is a plan view showing a condition in which the container has been mounted in the container mounting portion.

FIG. 6 is a plan view showing a condition in which the container 10 has been mounted in the container mounting portion 20.

The operation lever (knob) 51 by which the fixed cover holding member 24 is moved, is rotatably supported on a shaft 52 fixed to the mounting portion main body 21. A long groove portion 51A is provided on one end of the operation lever 51, and is engaged with 2 pins 24A protruded downward from the fixed cover holding member 24. The pins 24A slidingly move in 2 long groove portions 21A provided on the mounting portion main body 21.

When the knob portion of the operation lever 51 is grasped and rotated in the direction of one dotted chain line arrow shown in the drawing, the operation lever 51 is rotated around the shaft 52, the long groove portion 51A of the leading edge portion of the operation lever 51 presses the pin portion 24A, and moves it along the long groove portion 21A in the left direction in the drawing. When the pin portion 24A is moved left, the fixed cover holding member 24, integrated with the pin portion 24A, is moved left, and returns to the initial position shown in FIG. 4. At this initial position, the container 10 can be mounted/dismounted, and replaced.

A frame 61, holding the casing 31 of the drive portion 30, is oscillatable toward the front surface side by approximately 90° by support shafts 64 provided at upper and lower portions of a support member 63 integrated with a fixed frame 62 in the image forming apparatus.

Figure 7:
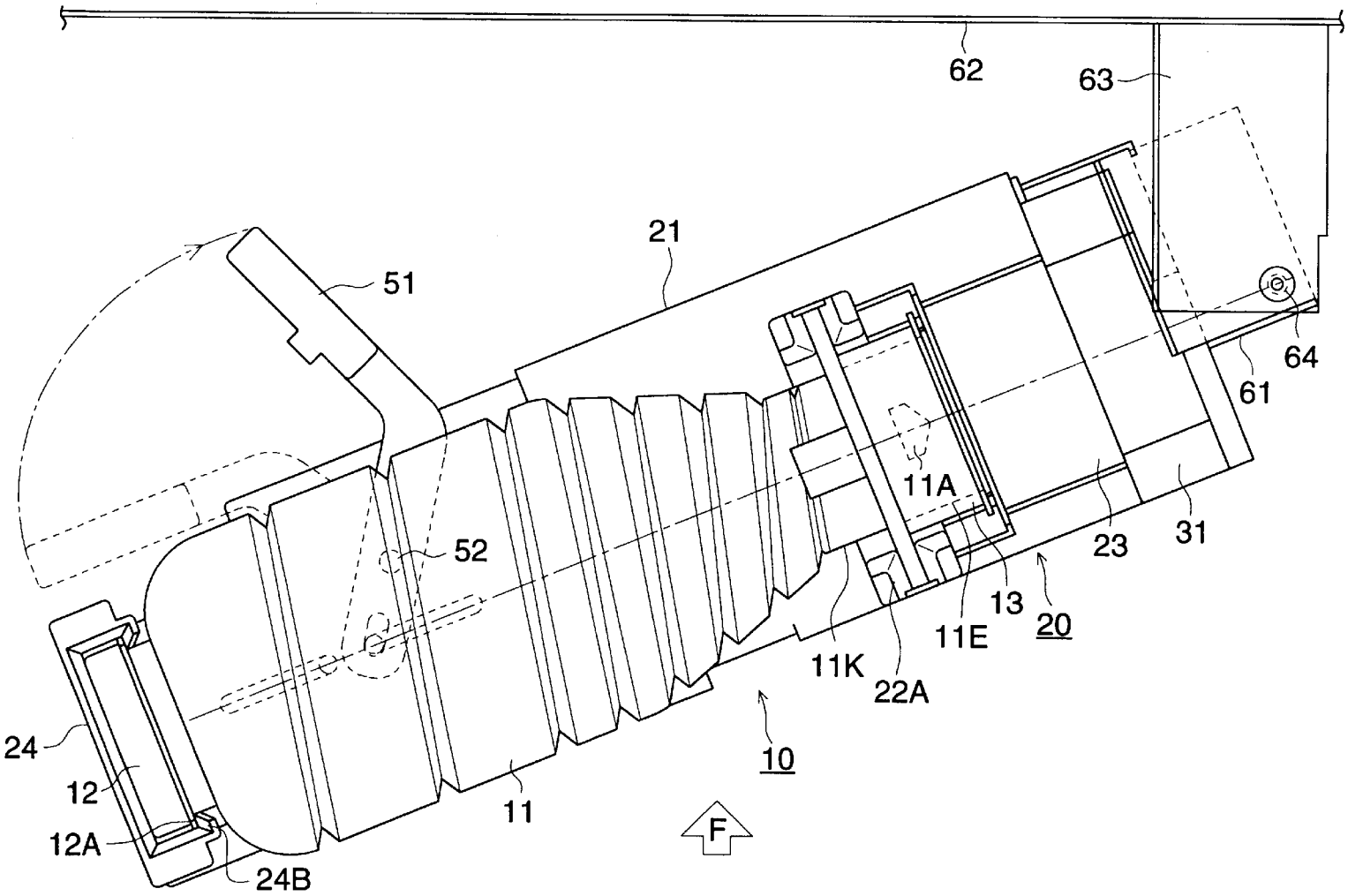
FIG. 7 is a plan view showing a condition in which the main body of the mounting portion is oscillated, so that the container can be taken out.

FIG. 7 is a plan view showing a condition in which the mounting portion main body 21 is oscillated, and thereby the container 10 can be taken out.

When a part of the mounting portion main body 21 is grasped and pulled out toward the front surface side F of the image forming apparatus, the mounting portion main body 21 is oscillated around the support shaft 64, and the container 10 is exposed to the front from the front end of the image forming apparatus.

Under this condition, when the operation lever 51 is operated toward the front and oscillated clockwise as shown in the drawing, the fixed cover holding member 24 is moved to the left shown in the drawing. By the movement toward the left of the fixed cover holding member 24, the engagement portion 24B of the fixed cover holding member 24 is moved in the direction of the left while engaging the end portion 12A of the fixed cover 12, and the container main body 11 integrated with the fixed cover 12 is also moved in the direction of the left.

However, because the slide cover 13 is mounted and fixed in the groove portion 22A of the slide cover holding member 22, the container main body 11 relatively moves to the slide cover 13, and the outer peripheral surface 11K of the container main body 11 slidingly moves from the porous member 25 in the container main body holding member 23 to the outside and is exposed. By this relative movement of the container main body 11 to the slide cover 13, the developing agent delivering port 11A provided on the outer peripheral surface 11K of the container main body 11 is closed by the flexible seal member 14 and the slide cover 13.

Under this condition, the leading edge portion of the hollow cylindrical wall surface portion 11E with the bottom of the container main body 11 is separated from the inside of the porous member 25 and inserted into the slide cover 13, and therefore the container 10 can be taken out.

When the container 10 is replaced with new one and the new container is mounted, or the original container is mounted again, the container mounting portion 20 is pulled out to the front side, as shown in FIG. 7, the operation lever 51 is rotated clockwise, and the container is mounted. Then, after the operation lever 51 is rotated counterclockwise, the mounting portion main body 21 is oscillated around the support shaft 64, stopped at the position shown in FIG. 6, and engaged by a lock means, not shown.

When the return operation of the operation lever 51 to the front side is forgotten, and the mounting portion main body 21 is tried to be oscillated and returned to the initial developing agent replenishing position under the condition shown in FIG. 7, then the leading edge portion of the operation lever 51 is brought into contact with the fixed frame 62 of the image forming apparatus main body side, thereby, the container mounting portion 20 can not be returned. Accordingly, oblivion of the operation easily becomes clear, thereby, the correct operation can be easily conducted again.

(1) In the developing agent replenishing device of the present invention, it is not conducted that the user peels the flexible seal member to close the developing agent replenishment delivering port, and that the developing agent container is mounted in the container mounting portion while the developing agent replenishment delivering port is opened. However, after the developing agent container has been mounted in the container mounting portion, the container main body is moved by the moving and holding member and the flexible seal member is peeled, so that the possibility that the user touches the developing agent is decreased. Further, when the developing agent container is mounted in the container mounting portion, it is not necessary that the rotational direction of the developing agent replenishment delivering port is positioned, and positioning is not necessary, so that the load for operation of the user can be decreased.

(2) In the developing agent container of the present invention, the movement holding member is structured to be moved by the operation lever (knob), thereby, the operation force for loading the developing agent container becomes light, and the operational easiness is increased. Further, when the developing agent container is forcibly pushed in the axial direction of the container mounting portion directly by hands and loaded into the mounting portion, air in the developing agent container, container mounting portion, and developing agent storing portion, is suddenly compressed, and thereby, there is a possibility that the accommodated developing agent blows out outside. However, by the operation of the operation lever of the present invention, the gentle loading operation can be conducted, thereby, the developing agent container can be mounted safely and assuredly.

(3) In the developing agent replenishing device of the present invention, the developing agent delivering port can easily be opened/closed by the movable slide cover and the flexible seal member, thereby, it is no possibility that the user's hand is stained and the surrounding is stained by spilling the developing agent from the delivering port of the container by mistake. Further, when the container is taken out from the container mounting portion after the developing agent delivering port has been opened, the flexible seal member closes the developing agent delivering port, thereby, the developing agent is prevented from exposing.

(4) In the developing agent replenishing device of the present invention, A: when the developing agent container is mounted in the container mounting portion, adjustment of a phase of the rotational direction of the developing agent container is not necessary, resulting in an increase of the operational easiness; B: the moving and holding member is structured so as to be moved by the operation lever, and the operation force for loading the developing agent container is decreased, thereby, the operational easiness is increased; C: the mounting portion main body is oscillated and the developing agent container is mounted/dismounted at the position exposed outside the image forming apparatus main body, thereby, the operational easiness of the developing agent replenishment is increased; D: when the developing agent container is mounted into and dismounted from the container mounting portion, the developing agent delivering port of the container main body is opened/closed by the operation lever, and the developing agent replenishing device can not be loaded into the image forming apparatus by the imperfect operation of the operation lever, thereby, a fool-proof means by the prevention of mis-loading can be easily attained; E: when the developing agent container is forcibly pushed in the axial direction of the container mounting portion directly by hands and loaded into the mounting portion, air in the developing agent container, container mounting portion, and developing agent storing portion, is suddenly compressed, and thereby, there is a possibility that the accommodated developing agent blows out outside, however, by the operation of the operation lever, the gentle loading operation can be conducted, thereby, the developing agent container can be mounted safely and assuredly.

What is claimed is:

1. A developing agent replenishing device comprising:

(a) a developing agent storing container having a spiral protrusion in an interior thereof, including a container main body for storing therein a developing agent and a movable cover for opening or closing a developing agent discharging opening provided on one end of the container main body;

(b) a container mounting section to which the storing container is mounted, wherein the developing agent stored in the storing container is discharged by rotating the storing container;

(c) a developing agent reserving section for reserving therein the developing agent discharged from the storing container;

(d) a cover engagement section for engaging with the movable cover when the storing container is mounted to the container mounting section; and (e) a holding and moving means for holding a part of the storing container and for moving the storing container when the storing container is mounted to the container mounting section, wherein the movable cover and the storing container main body are relatively moved by moving the storing container by the holding and moving means, thereby the discharging opening is opened, and consequently communicates with the developing agent reserving section so that the developing agent in the storing container can be discharged.

2. The developing agent replenishing device of claim 1, wherein the holding and moving means moves the storing container, thereby the movable cover opens or closes the discharging opening.

3. The developing agent replenishing device of claim 1, wherein the holding and moving means comprises a holding and moving member and a knob connected with the holding and moving member, and the holding and moving member is moved by rotating the knob in a predetermined direction, thereby the storing container is moved.

4. The developing agent replenishing device of claim 1 further comprising a flexible sealing member for sealing the discharging opening, wherein the flexible sealing member is pealed off by moving the storing container main body by the holding and moving member, thereby the discharging opening can be opened.

5. The developing agent replenishing device of claim 1, wherein a main body of the container mounting section is oscillatively supported around a reciprocating shaft provided on a main body of the apparatus, and when the knob is operative at a position where the main body of the container mounting section is protruded outward the main body of the apparatus by reciprocating the main body of the container mounting section, the storing container is detachably attachable to the container mounting section.

6. The developing agent replenishing device of claim 1, wherein the container mounting section is provided with a porous member capable of being resiliently deformed on a contact surface with the storing container.

* * * * *